US006181312B1

(12) United States Patent
Sekine

(10) Patent No.: US 6,181,312 B1
(45) Date of Patent: Jan. 30, 2001

(54) DRIVE CIRCUIT FOR AN ACTIVE MATRIX LIQUID CRYSTAL DISPLAY DEVICE

(75) Inventor: Hiroyuki Sekine, Tokyo (JP)

(73) Assignee: NEC Corporation (JP)

( * ) Notice: Under 35 U.S.C. 154(b), the term of this patent shall be extended for 0 days.

(21) Appl. No.: 09/229,214

(22) Filed: Jan. 13, 1999

(30) Foreign Application Priority Data

Jan. 14, 1998 (JP) ..... 10-005844

(51) Int. Cl.[7] ..... G09G 3/36
(52) U.S. Cl. ..... 345/98; 345/100
(58) Field of Search ..... 345/98, 100, 196, 345/198

(56) References Cited

U.S. PATENT DOCUMENTS 5,625,376 * 4/1997 Maekawa ..... 345/132
5,708,405 * 1/1998 Maekawa ..... 345/100
5,844,539 * 12/1998 Kitagawa ..... 345/100
6,018,331 * 1/2000 Ogawa ..... 345/99

FOREIGN PATENT DOCUMENTS 736406 2/1995 (JP) ..... G09G/3/20
8305316 1/1996 (JP) ..... G09G/3/20
8122747 5/1996 (JP) ..... G02F/1/133
9-146498 6/1997 (JP) ..... G09G/3/36

* cited by examiner

*Primary Examiner*—Richard A. Hjerpe
*Assistant Examiner*—Alexander Eisen
(74) *Attorney, Agent, or Firm*—Hayes, Soloway, Hennessey, Grossman & Hage, P.C.

(57) ABSTRACT

A gate driver circuit for driving an active matrix LCD device is adapted to a mutli-scan function. The gate driver circuit includes a memory circuit including a plurality of (N) memory cells each disposed for a corresponding one of gate lines in the LCD device, a scan circuit including N transfer elements, and a gate line drive circuit including N logic units effecting a specific logic operation. The logic units consecutively drives gate lines in the central area in the picture writing period for displaying a picture image, and drives gate lines in the top and bottom peripheral areas at once for displaying black color. The LCD device displays the picture image on the central area on a selected number of pixel elements for adapting an image source.

5 Claims, 11 Drawing Sheets

DRIVE CIRCUIT FOR AN ACTIVE MATRIX LIQUID CRYSTAL DISPLAY DEVICE

BACKGROUND OF THE INVENTION (a) Field of the Invention

The present invention relates to drive circuit for an active matrix liquid crystal display (LCD) device.

(b) Description of the Related Art

LCD devices now in widespread use are of an active matrix type in which thin film transistors (referred to as TFTs, hereinafter) are integrated as active elements in respective pixel elements. TFTs are generally classified into two types including amorphous silicon TFTs and polysilicon TFTs based on the semiconductor materials used therein.

In an LCD device using polysilicon TFTs having a high current driving capability, the polysilicon TFTs can be also provided in the peripheral circuits, thereby allowing the peripheral circuits to be disposed on the same substrate for the LCD device to achieve the advantage of a smaller circuit scale. Such an LCD device having peripheral circuits integrated therewith on the same substrate is called a drive circuit integrated LCD. A drive circuit integrated LCD device includes a data driver and a gate driver as peripheral circuits. The data driver drives data lines connected to source terminals of the TFTs in the pixel elements, whereas the gate driver drives gate lines connected to the gate terminals of the TFTs in the pixel elements. The drive circuit integrated LCD devices are widely used for liquid crystal (LC) projectors in which a compact circuit scale and a high-definition image quality are required.

In accordance with the increasing variety of image signal sources in recent years, LC projectors are expected to have a multi-scan function for displaying image signals of wide frequency bands. Therefore, the driver circuits should have the mutli-scan function in the drive circuit integrated LCDs for use in (LC) projectors.

An LCD device differs from a CRT in that the number of pixel elements cannot be changed in the LCD device depending on the image signals supplied thereto. In the LCD device, therefore, a picture image is generally displayed on a number of pixel elements fewer than the number of all the pixel elements provided in the LCD. In this case, the mutli-scan function is commonly realized according to either of the following two methods. In a first method, the image signal is displayed on a part of the display area, In a second method, the number of pixel elements for a picture image is modified at the same ratio i both longitudinal and lateral directions of the display area, thereby approaching the number of pixel elements displaying at that time to the total number of the pixel element provided in the LCD device. The present invention relates to the first method.

FIG. 1 shows a typical display area for explaining the first display method. The display area includes 1280 (horizontal)×1024 (vertical) pixel elements on the screen. The figure also shows a central picture area based on the SVGA standard, one of the display standards in personal computers. The central picture area includes 800 (horizontal)×600(vertical) pixel elements. This means that the picture image is displayed on the 800×600 pixel elements in the central area of the display, and the peripheral area is displayed in black color by preventing the light transmission in the non-display peripheral area.

An active matrix LCD is generally driven by a normally white mode of TN (twisted nematic) LC so as to improve its contrast ratio. The normally white mode is a known driving method in which light is transmitted through a LC pixel element when a voltage is not applied thereto. In order to display the black color in the normally white driving method, a black signal for displaying black color must be written into the peripheral areas during vertical blanking periods, i.e., periods when a picture image is not displayed. The vertical blanking period lasts only a short time, about 4 millisecond (msec.) for example, This causes a problem in that it is difficult to write all the signals for displaying the black color into desired areas during the vertical blanking period.

Patent Publication JP-A-8-122747 proposes a driving method for solving the aforementioned problem. In the proposed driving method, a gate driver circuit is operated in a high speed during the vertical blanking periods so as to write the black data into all the peripheral areas simultaneously. FIG. 2 is a circuit diagram for showing a gate driver circuit having a function of writing the black data simultaneously into the top and bottom peripheral areas illustrated in FIG. 1. The gate driver circuit includes a scan circuit A1 having transfer elements $\mathbf{A1}_1$–$\mathbf{A1}_N$ connected in N stages, and N decode units A4 each disposed for a corresponding one of the transfer elements $\mathbf{A1}_1$–$\mathbf{A1}_N$ in the scan circuit A1. Each of the decode units A4 includes four NAND gates A41 and four inverters A42. In the scan circuit A1, a start pulse SP is received ill synchrony with a clock signal CLK, and the data held by the first stage transfer element $\mathbf{A1}_1$ is shifted one stage by one stage from the left toward the right of the scan circuit A1. In the decode units A4, each of the outputs from the transfer elements $\mathbf{A1}_1$–$A_N$ of the respective stages in the scan circuit A1 is divided into four pulses based on M (eight, in this case) decode signals $DC_1$–$DC_8$.

FIG. 3 shows a timing chart of the gate driver circuit shown in FIG. 2. A frame period Tf is divided into a first period Tnm for displaying a picture image and a second period Tbw for writing data into the black color areas including the top and bottom peripheral areas.

In the first period Tnm, the scan circuit A1 is synchronized with a clock signal CLK having a period which is fourfold the period of the horizontal synchronizing signal for the image signal Vsig to receive the start pulse SP in the scan circuit A1, whereby outputs $S_1$–$S_N$ shown in the figure are obtained. Doing the first period Trim, image signals are written in a picture writing period Ta, during which decode signals $DC_1$–$DC_8$ are supplied. Thus, respective signals of the outputs $S_{a+1}$–$S_b$ which assume a high level within the period Ta are quartered based on the decode signals $DC_1$–$DC_8$, thereby outputting pulses sequentially through the output terminals $G_{4a+1}$–$G_{4b}$. In addition, by equalizing the respective pulse widths of the decode signals $DC_1$–$DC_8$ with one horizontal period, the widths of the respective pulses delivered from the output terminals $G_{4a+1}$–$G_{4b}$ are equalized with one horizontal period. With these pulses, the gate lines are driven to write the picture data.

FIG. 4 is an enlarged timing chart showing the second period Tbw shown in FIG. 3. In the second period Tbw, the clock signal CLK is changed to have a frequency which is three or more digits higher than the frequency of the horizontal synchronizing signal, and a start pulse SP of a smaller pulse width is supplied. In the second period Tbw, delivery of the clock signal CLK is stopped for a clock signal stop period Tw after supplying a number of clock pulses equal to the number of the stages of the transfer elements $\mathbf{A1}_1$–$\mathbf{A1}_N$ in the scan circuit A1. Here, in the respective stages of the transfer elements $\mathbf{A1}_1$–$\mathbf{A1}_N$ in the scan circuit A1, the outputs $S_1$–$S_a$ and $S_{b+1}$–$S_N$ assume a high level, and the outputs $S_{a+1}$ –$S_b$ assume a low level.

Since a high level of the decode signals $DC_1$–$DC_8$ is supplied during the clock signal stop period Tw, all the outputs of the is decode units A4 connected to the outputs $S_1$–$S_a$ and $S_{b+1}$–$S_N$ assume a high level. Subsequently, N or more clock pulses are supplied so that the outputs of all the transfer elements $A1_1$–$A1_N$ in the scan circuit A1 assume a low level.

In the following description of the drive circuit of FIG. 2, it is assumed that the stage number N of the transfer elements in the scan circuit A1 is 256, "a" is 53, and "b" is 203, for example. In the first period Tnm, gate lines $G_{(4\times53+1)}$–$G_{(203\times4)}$, that is, 600 gate lines $G_{213}$–$G_{812}$ are sequentially activated to write a picture image in synchrony with the horizontal synchronizing signal. Then, in the second period Tbw, gate lines $G_1$–$G_{(4\times53)}$ and $G_{(203\times4+1)}$–$G_{(256\times4)}$, that is, gate lines $G_1$–$G_{212}$ and $G_{813}$–$G_{1024}$ are set at a high level all at once. In this state, the data lines are supplied with a signal (black signal) for displaying black color, whereby all the black data is written at once into the top and bottom black areas simultaneously.

In the proposed driving method, assuming that the scan circuit A1 has a large number of transfer elements, for example, more than 200 stages of transfer elements, an extremely high-speed operation must be performed in all the transfer elements. In addition, an additional external dive circuit is required for realizing complicated operations such as switching the frequency of the clock signal CLK so as to drive all the gate lines for black areas simultaneously during a vertical blanking period. This causes problems such as a complex design of the external drive circuit for realizing the operation and a larger scale of the drive circuit.

SUMMARY OF THE INVENTION

In view of the foregoing, it is an object of the present invention to provide a driver circuit for an active matrix LCD, which is capable of simplifying the procedure of the mutli-scan function for writing the black data into the top and bottom black areas, of facilitating the simplified design of an external drive circuit, and of preventing larger circuit scales.

The present invention provides a drive circuit for an active matrix LCD device operating for a picture wring period and a vertical blanking period. The drive circuit includes:

a memory circuit including a plurality of memory cells each disposed for a corresponding group of gate lines of the LCD device, the memory circuit storing a first data in each of the memory cells corresponding to selected groups of the gate lines and an inverted first data in each of the other group of the memory cells, a plurality of cascaded transfer elements, each disposed for a corresponding one of the memory cells, for shifting clock pulses in a second clock signal along the transfer elements, the second clock signal being in synchrony with the first clock signal, and a gate line drive Circuit including a plurality of logic units each disposed for a corresponding one of the memory cells, each of the logic units outputting a result signal based on a logic operation $M_n{*}S_nXBW+XM_n{*}BW$ to a corresponding group of the gate lines, wherein Mn, XMn, Sn, BW, XBW and XMn represent the first data from one of the memory cells corresponding to the each of the logic unit the inverted first data, an output of one of the transfer elements corresponding to the each of the logic units, a control signal having a logic value depending on the picture writing period or the vertical blanking period, and an inverted control signal, respectively.

In accordance with the drive circuit for an LCD device of the present invention, the black data can be written into the selected areas at once so that the clock frequency for writing the black data can be reduced compared to the conventional drive circuit.

The above and other objects, features and advantages of the present invention will be more apparent from the following description, referring to the accompanying drawings.

DETAILED DESCRIPTION OF THE PREFERRED EMBODIMENTS

Figure 1:
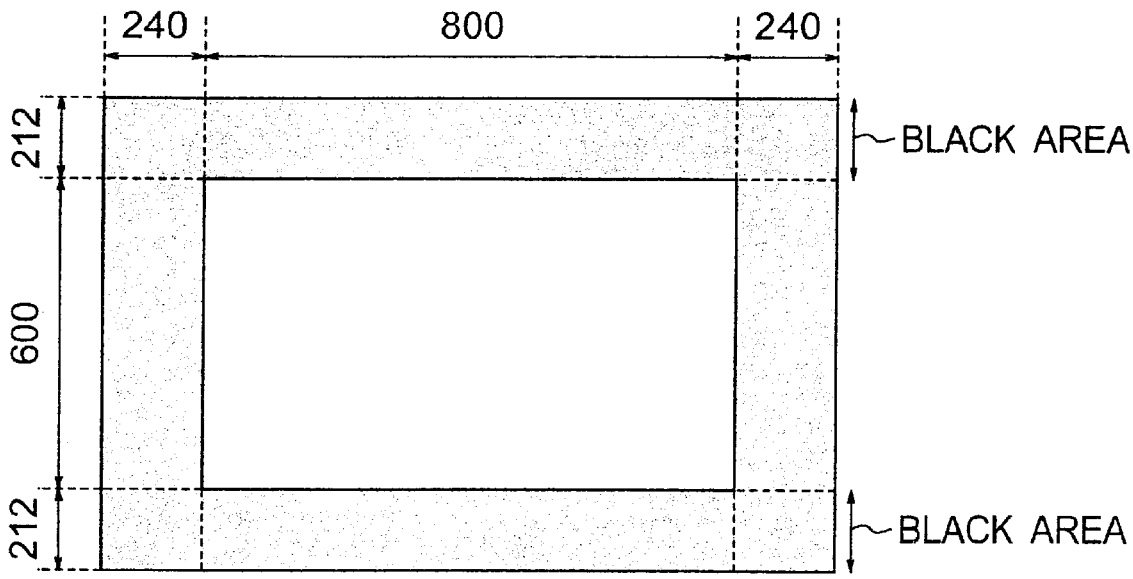
FIG. 1 is a front view showing a typical display area of a conventional active matrix LCD device.
Figure 2:
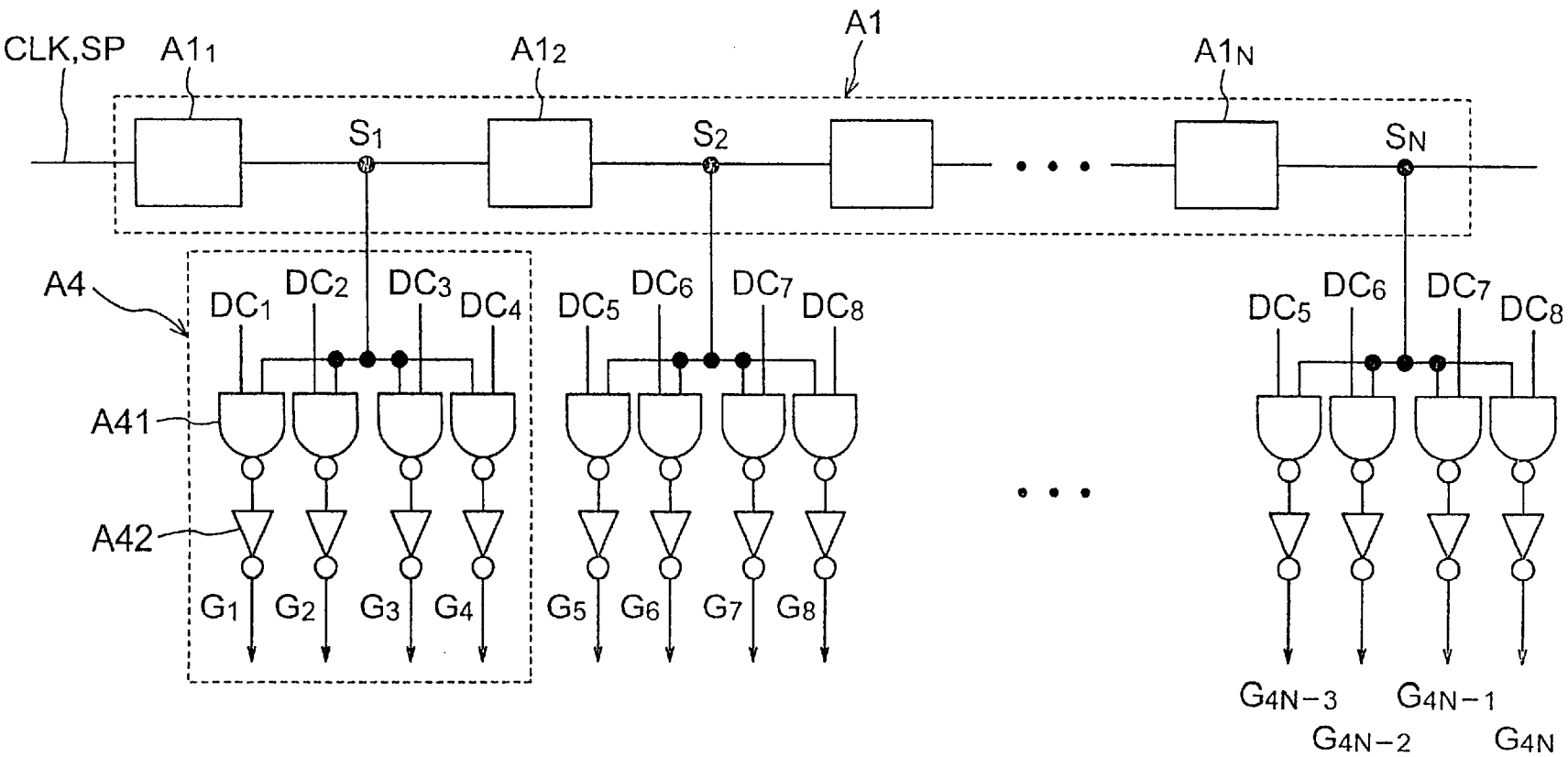
FIG. 2 PRIOR ART
FIG. 2 is a circuit diagram showing a gate driver circuit for simultaneously writing black data into the top and bottom peripheral areas in the LCD device of FIG. 1.
Figure 3:
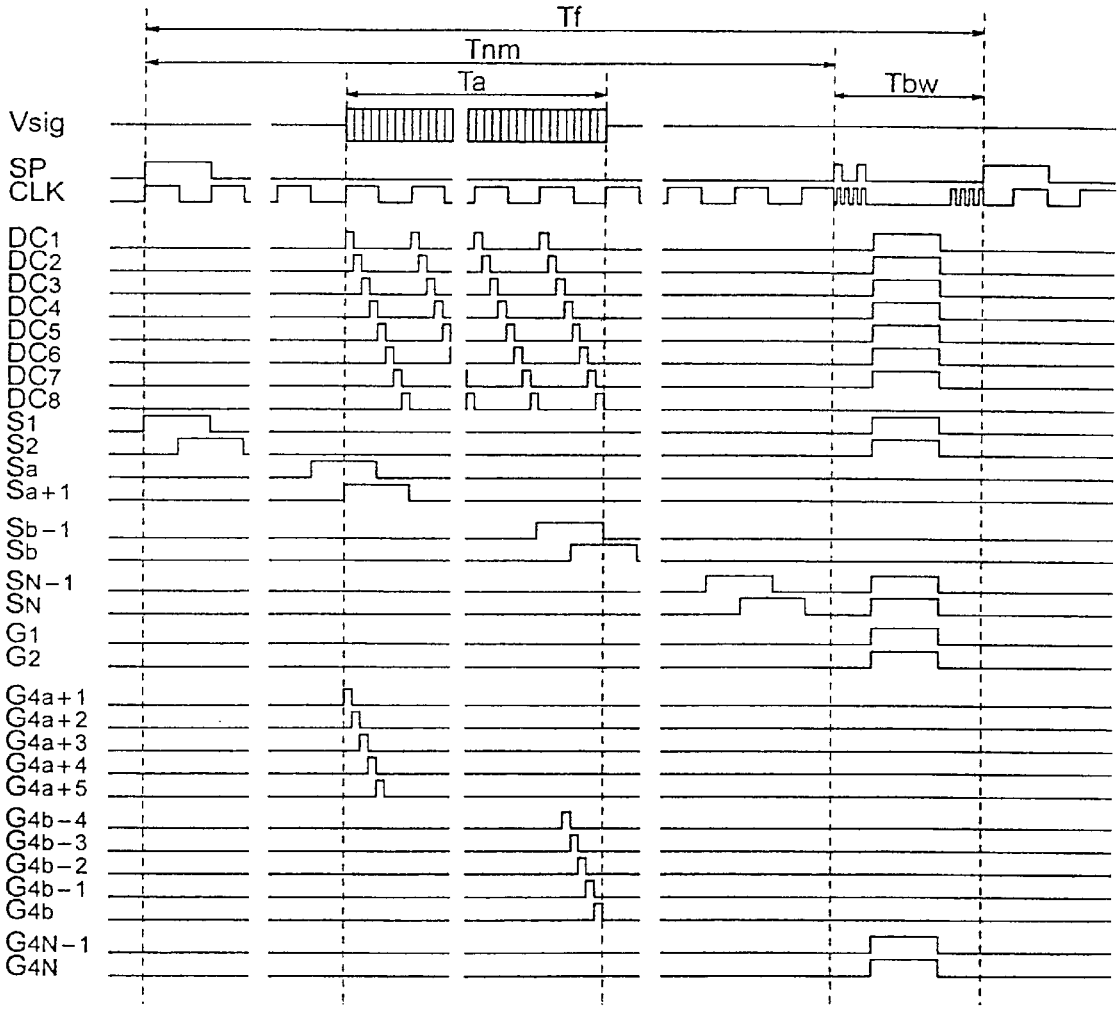
FIG. 3 PRIOR ART
FIG. 3 is a timing chart of the gate driver circuit of FIG. 2.
Figure 4:
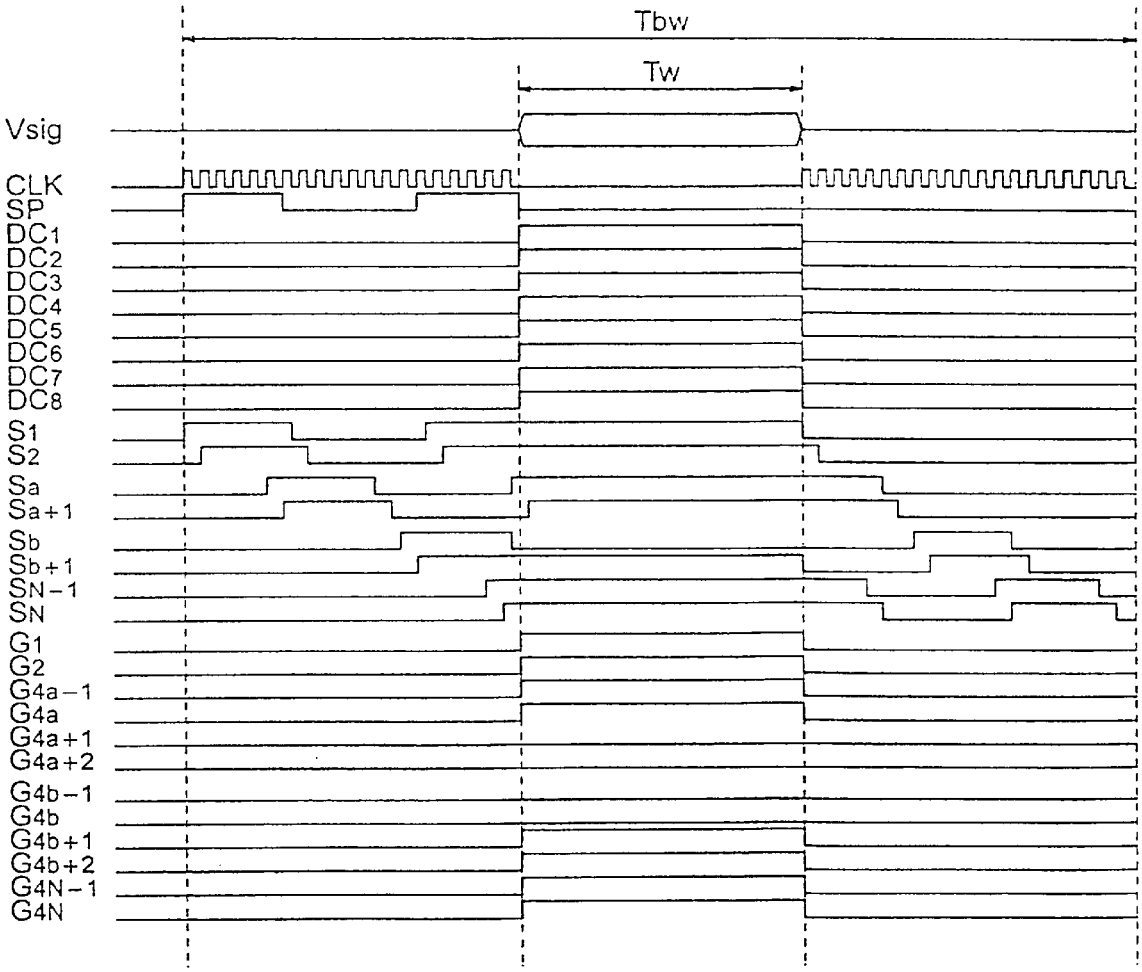
FIG. 4 PRIOR ART
FIG. 4 is an enlarged timing chart for the second period in FIG. 3.
Figure 5:
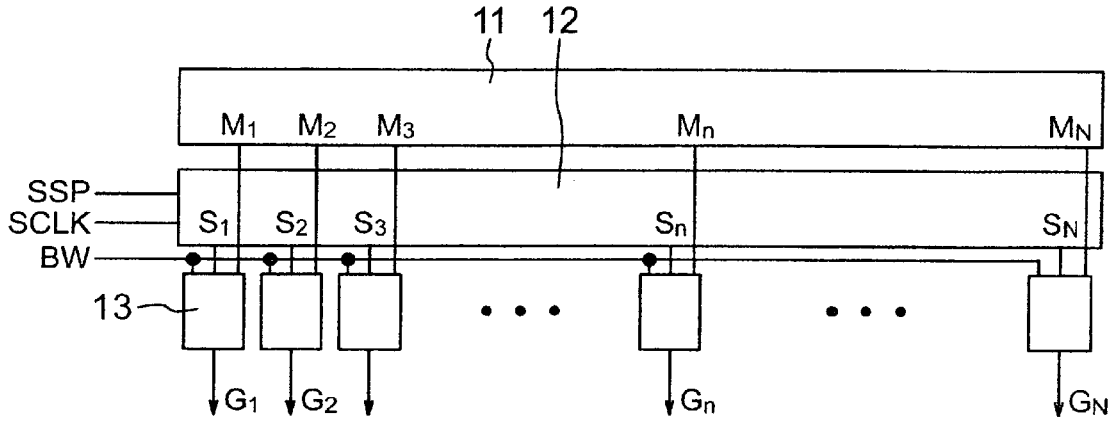
FIG. 5 is a circuit diagram of a gate driver circuit of an active matrix LCD device according to a first embodiment of the present invention.

Hereafter, the present invention will be described in more detail wit reference to the accompanying drawings. Referring to FIG. 5, a gate driver circuit for an active matrix LCD device according to a first embodiment of the present invention includes a memory circuit 11 including memory cells in number N which is equal to the number of gate lines, and N output terminals for outputting data stored in the respective memory cells in the memory circuit 11. The gate driver circuit further includes a scan circuit 12 including transfer elements in number (N) corresponding to the number of the memory cells in the memory circuit 11, and a gate line drive circuit including N logic units 13. The scan circuit 12 is implemented by a shift register having N output terminals for outputting data stored in the respective transfer elements. Each logic unit 13 receives a common control signal BW, an output $M_n$ from a corresponding output of the memory circuit 11 and an output $S_n$ from a corresponding output of the shift register 12.

The memory circuit 11 is such that the storage data can be supplied from outside. The scan circuit 12 receives a clock signal SCLK and a start signal SSP as control signals therefor. The clock signal SCLK has the same frequency as the horizontal synchronizing signal. In each of the logic units 13, a logical operation $M_n*S_n*XBW+XM_n*BW$ is performed, where $M_n$ is an output from the n-th memory cell in the memory circuit 11, $S_n$ is an output from the n-th transfer element in the scan circuit 12, BW is the control signal, and XBW and XMn are inverted BW signal and inverted Mn signal, respectively. The results of the operations are output to respective gate lines of an LCD (not shown).

The gate driver circuit of FIG. 5 operates an LCD to display a picture image on the pixel elements in number fewer than the number of pixel elements provided in the LCD, as follows. First, a positive logical value "1" (or may be 0, alternatively) is written into the memory cells in the memory circuit 11 corresponding to the selected gate lines connected to the pixel elements to display a picture image, and a negative logical value "0" (or may be 1 depending on the value for the positive logical value) is written into the other memory cells. This operation is performed at least once in the start of the operation of the LCD or when the number of the pixel elements for displaying the picture image is changed.

During a picture writing period in which image signals are written into the display area of the LCD, the control signal BW is set at a negative logical value, and the scan circuit 12 is driven in synchrony with the horizontal synchronizing signal (clock signal SCLK) of the image signals. This sequentially drives the gate lines corresponding to the memory cells that store the positive logical value.

During a vertical blanking period in which image signals are not written, the control signal BW is set at a positive logical value. This simultaneously drives the output terminals corresponding to the memory cells storing the negative logical value in the memory circuit 11. During this period, a black signal is supplied to all the data lines in the LCD, whereby black data is written into both top and bottom peripheral areas at once. At this stage, the top and bottom black areas can be driven by a frame inversion scheme or a data line inversion scheme.

Figure 6:
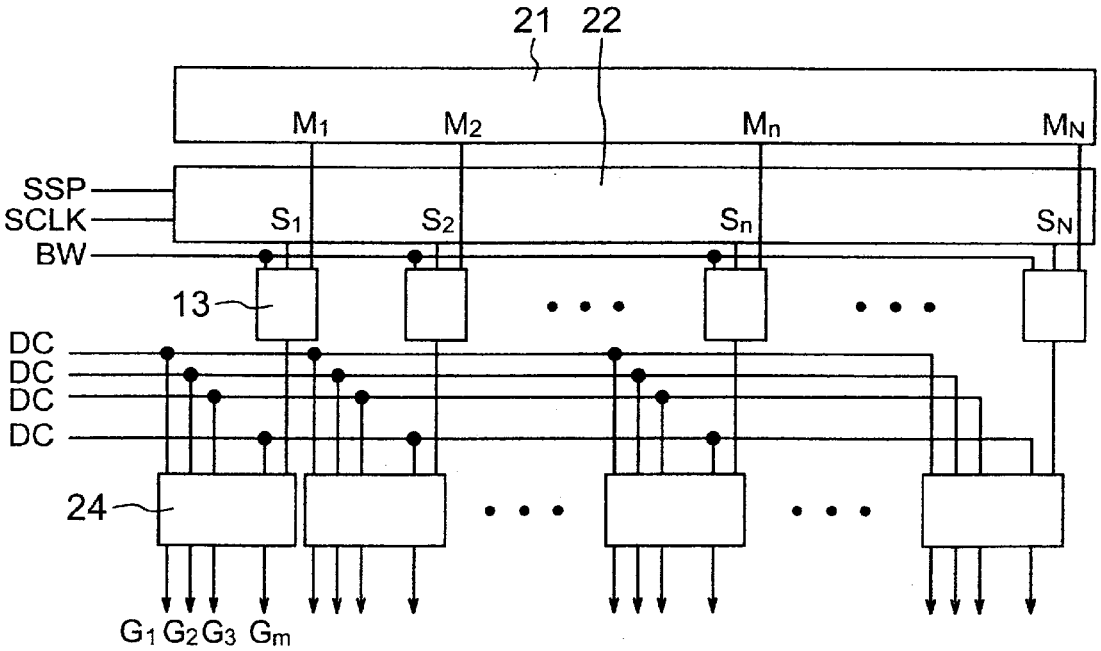
FIG. 6 is a circuit diagram of a gate driver circuit of an active matrix LCD device according to a second embodiment of the present invention.

Referring to FIG. 6, a gate driver circuit according to a second embodiment of the present invention is also suited for driving an active matrix LCD device for a LC projector. The gate driver circuit includes a memory circuit 21 having a plurality of memory cells each disposed for a group of gate lines, a scan circuit 22 having cascaded transfer elements each disposed for a corresponding memory cell, and a gate line drive circuit including N logical units 23 each corresponding to the group of gate lines. The gate line drive circuit further includes N decode units 24, which receive the outputs of the respective logical units 23 and decode signals $DC_1$–$DC_m$(where m is a positive even number larger than N). Each decode unit 24 has m output terminals corresponding to the number of gate lines in each group of the gate lines.

The memory circuit 21 is such that the storage data can be supplied, from outside. The scan circuit 22 is implemented by a shift register having transfer elements in number same as the number of the memory cells. The scan circuit 22 receives control signals including a start signal SSP and a clock signal SCLK having a frequency equal to 1/m of the frequency of the horizontal synchronizing signal. In each logical unit 23, a logical operation $M_n*S_n*XBW+XM_n*BW$ is performed, where given symbols are similar to those described with reference to the first embodiment. The results of the operations are output to the respective decode units 24. Each decode unit 24 receives the output from a corresponding logical unit 23 and decode signals $DC_1$–$DC_m$, and divides the output from the logical unit 23 into a number of m based on the decode signals $DC_1$–$DC_m$, thereby delivering the results of the operation to a corresponding gate line as the output of the gate driver circuit.

The gate driver circuit of the second embodiment can be adapted to operate an LCD device to display a picture image on pixel elements in number fewer than the number of pixel elements in the LCD device, based on the following two ways.

In the first driving scheme, the sequential numbers of the output terminals for driving selected gate lines connected to the pixel elements for displaying a picture image are respectively divided by m to obtain divided numbers, m corresponding to a number of gate lines included in each group of gate lines. Then, a positive logical value is written into the memory cells in the memory circuit 11 having a sequential number corresponding to the divided numbers, whereas a negative logical value is written into the other memory cells. The operation is performed at least once at the start of the operation of the LC) or when the number of the pixel elements for displaying the image signal is changed.

During a picture writing period, the control signal BW is set at a negative logical value, and the scan circuit 22 is driven in synchrony with the horizontal synchronizing signal (clock signal SCLK) of the image signals. This sequentially drives the gate lines connected to the output terminals of the decode units 24 corresponding to the sequential numbers of the memory cells storing the positive logical value in the memory circuit 21.

During a vertical blanking period, the control signal BW is set at a positive logical value, and all the decode signals $DC_1$–$DC_m$ are set at a positive logical value. This drives at once the output terminals of the decode units 24 that correspond to the sequential numbers of the memory cells storing the negative logical value. In this period, a black signal is applied to all the data lines in the LCD, whereby black data is written into the top and bottom peripheral areas at once. In this case, the top and bottom areas can be driven by a frame inversion scheme or a data line inversion scheme.

In the second driving scheme, the sequential numbers of the output terminals for driving selected gate lines connected to the pixel elements for displaying a picture image are divided by m to obtain divided numbers. Then, a positive logical value is written into the memory cells in the memory circuit 11 having sequential numbers corresponding to the divided numbers, whereas a negative logical value is written into the other memory cells. This operation is performed at least once in the start of the operation of the LCD or when the number of the pixel elements for displaying the image signal is changed.

In a picture writing period, the control signal BW is set at a negative logical value, and the scan circuit 22 is driven in synchrony with the horizontal synchronizing signal (clock signal SCLK) of the image signals. In addition, a decode signal, having a pulse width which is smaller than the period of the horizontal synchronizing signal and a period which is same as that of the clock signal SCLK, is supplied to the decode lines $DC_1$–$DC_m$ after dividing the decode signal into m phases. As a result, signals are sequentially received through the output terminals of the decode units 24 that correspond to the sequential numbers of the memory cells storing the positive logical value in the memory circuit 21, The vertical blanking period is divided into two or more sub-periods. In one of the sub-periods, the control signal BW is set at a positive logical value, and only the signals from the odd-numbered decode lines among the decode lines $DC_1$–$DC_m$ are set at a positive logical value. This allows a simultaneous delivery of all the signals of the odd-numbered output terminals among the outputs of the decode units 24 that correspond to the sequential numbers of the memory cells storing the negative logical value in the memory circuit 21. In the other sub-period, the control signal BW is set at a positive logical value, and only the signals from the even-numbered decode lines among the decode lines $DC_1$–$D_m$ are set at a positive logical value. This allows simultaneous delivery of all the signals from the even-numbered output terminals among the outputs of the decode units 24 that correspond to the sequential numbers of. the memory cells storing the negative logical value. At this stage, by applying a black signal to all the data lines in the LCD, black data is written into the top and bottom black areas based on a time-division scheme alternately in the pixel elements connected to the odd-numbered gate lines and in the pixel elements connected to the even-numbered gate lines. In this configuration, the top and bottom black areas can be driven by any of a frame inversion scheme, a data line inversion scheme, a gate line inversion scheme and a dot inversion scheme.

Figure 7:
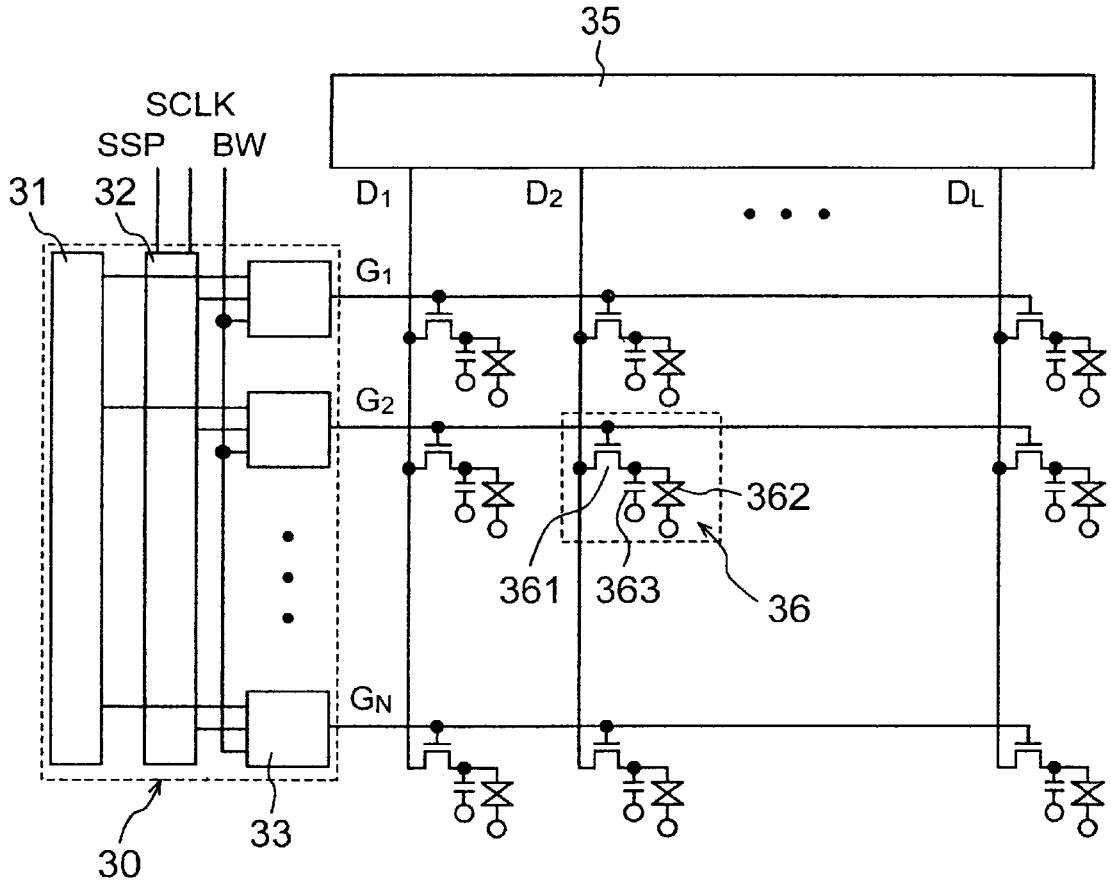
FIG. 7 is an overall circuit diagram of the active matrix LCD device having the drive circuit shown in FIGS. 5 or 6.

FIG. 7 shows an LCD having the gate driver circuit of the first embodiment or the second embodiment. The LCD includes a pixel matrix having a plurality of (L×M) pixel elements 36 arranged in a matrix, L data lines $D_1$–$D_L$ disposed for a corresponding column of the pixel elements, and N gate lines $G_1$–$G_N$ disposed for a corresponding row of the pixel elements. Each pixel element 36 includes a TFT 361 implemented as an active element, a LC capacitor (pixel capacitor) 362 and a storage capacitor 363. A data driver circuit 35 for driving the data lines and a gate driver circuit 30 for driving tee gate lines are provided on the same substrate as that of the pixel matrix. This realizes an active matrix LCD device having a compact size. The gate driver circuit 30 corresponds to the first embodiment, and includes a memory circuit 31, a scan circuit 32 and logical units 33. In the case of applying the gate driver circuit according to the second embodiment to the LCD of FIG. 7, decode units are provided in addition to the memory circuit 31, the scan circuit 32 and the logical operation units 33. In this case, the gate driver circuit 30 including the decode units is provided on the substrate for the LCD panel.

The LCD of FIG. 7 can be driven using the gate driver circuit 30 so as to display a picture image on the pixel elements in number fewer than the number of pixel elements provided in the LCD as well as to display black data in the peripheral areas including the top and bottom areas where the picture image is not displayed.

Figure 8:
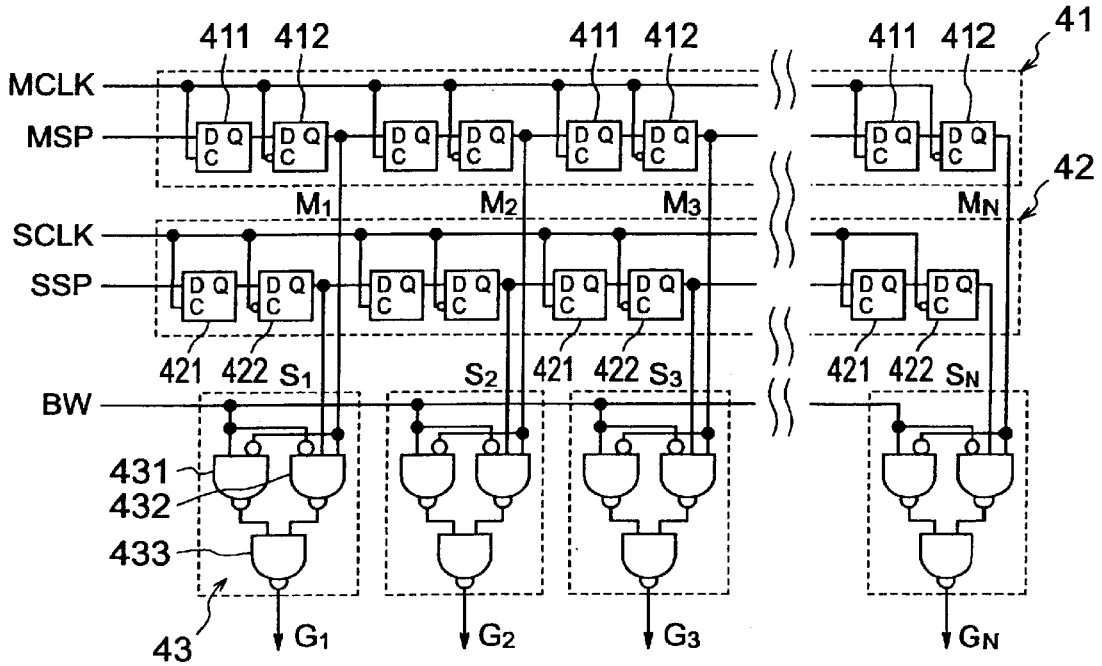
FIG. 8 is a circuit diagram of a concrete example of the gate driver circuit shown in FIG. 5.

Referring to FIG. 8, there is shown a practical example of the gate driver circuit of FIG. 5. The memory circuit 41 includes N memory cells, each of which includes a pair of D-type flip-flops (hereinafter, referred to as D-FFs) 411 and 412. A clock signal MCLK and a control signal MSP are input to the memory circuit 41. The D-FF 411 receives a data through the data input "D" thereof at the rising edge of the clock signal MCLK, and holds the data until the next rising edge of the clock signal MCLK. The D-FF 412 receives a data through the data input "D"thereof on the falling edge of the clock signal MCLK, and holds the data until the next falling edge of the clock signal MCLK As a result, the memory circuit 41 latches data in the control signal MSP through the first memory cell, having a sequential number of 1, on the rising of the clock signal MCLK, and then sequentially transfers the latched data toward the succeeding memory cells based on the clock pulses of the clock signal MCLK. The data stored in the respective memory cells are supplied through the respective output terminals $M_1$–$M_N$.

Since the clock signal MCLK can be selected to have any arbitrary frequency, the clock signal MCLK may have the same frequency and the same phase as the clock signal SCLK In such a case, a clock signal from a single oscillator may be supplied to both the memory circuit 41 and the scan circuit 42, thereby allowing a simple circuit structure.

The scan circuit 42 is implemented by a shift register having transfer elements cascaded in N stages, each of which includes a pair of D-FFs 421 and 422. A clock signal SCLK and a control signal SSP are input thereto. The scan circuit 42 latches data in the control signal SSP through the first transfer element (sequential numbered of 1) at the rising edge of the clock signal SCLK, and then transfers the data toward the succeeding transfer elements one stage by one stage based on the clock pulses in the clock signal SCLK The outputs of the respective transfer elements are delivered through the respective output terminals $S_{1-SN}$.

The logical units 43 are provided in number N corresponding to the number of the memory cells in the memory circuit 41 or the number of the transfer elements in the scan circuit 42. Each of the logical units 43 includes three NAND gates including NAND gate 431 for receiving the control signal BW and an inverted output from a corresponding output terminal Mn of the memory circuit, NAND gate 432 for receiving the inverted control signal XBW, outputs from a corresponding output terminal Mn of the memory circuit 41 and a corresponding output terminal Sn of the scan circuit 42, and NAND gate 433 for receiving outputs from NAND gates 431 and 432. By these configurations, each logical unit 43 performs a logical operation $M_n{*}S_n{*}XBW+XM_n{*}BW$, and delivers an output Gn ($1 \leqq n \leqq N$) through a corresponding output terminal If the control signal BW assumes a negative logical value, the outputs $G_1$–$G_N$ of the gate driver circuit coincide with the outputs of the scan circuit 42 only when the data stored in the memory cells in the memory circuit 41 assume a positive logical value, to display a picture image. On the other hand, if the control signal BW assumes a positive logical value, the outputs of the gate driver circuit assume a positive logical value, when the data stored in the memory cells in the memory circuit 41 assume a positive logical value, irrespective of the outputs of the scan circuit 42, to display black color.

In operation, the gate driver circuit of FIG. 8 assumes two modes including a black data writing mode in which the memory circuit 41 is written for displaying black color, and a normal display mode in which a picture image is displayed.

Figure 9:
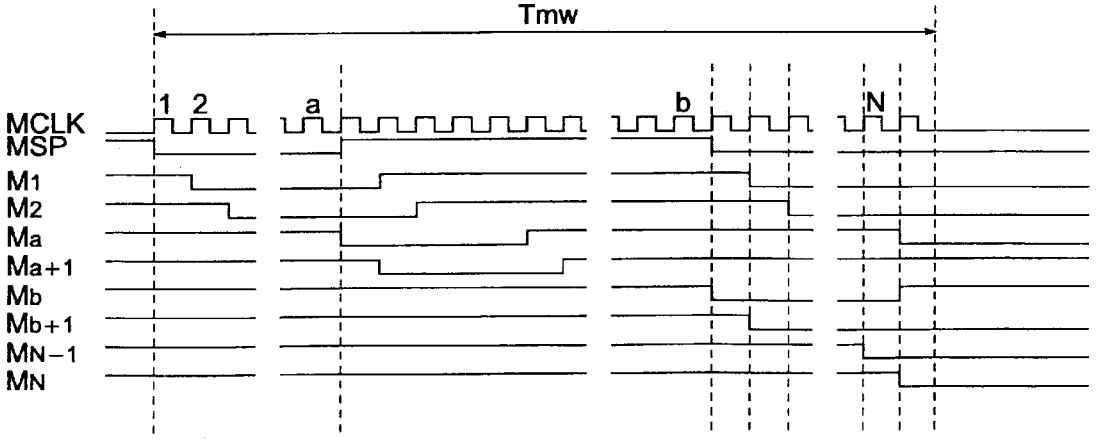
FIG. 9 is a timing chart of writing data in the memory circuit in the drive circuit of FIG. 8.

Hereafter, it is assumed that an LCD driven by the gate driver circuit displays a picture image with pixel elements in number fewer than the number of the pixel elements provided in the LCD. Referring to FIG. 9, suppose that black color is to be displayed on the pixel elements connected to the (a+1)-th to b-th gate lines during a black data writing period Tmw for the memory circuit 41. The N+1 clock signals MCLK are supplied to the memory circuit 41, to raise the control signal MSP synchronizing with the clock signal MCLK to a high level at a given timing.

Thus, the control signal MSP assumes a negative logical value during the first to a-th clock pulses of the clock signal MCLK, assumes a positive logical value during the (a+1)-th to b-th clock pulses, and again assumes a negative logical value during the (b+1)-th to N-th clock pulses. Accordingly, after N+1 clock pulses of the clock pulse signal MCLK have passed, the data stored in the memory circuit 41 is such that first to a-th memory cells have a negative logical value, (a+1)-th to b-th have a positive logical value, and (b+1)-th to N-th have a negative logical value. At this stage, delivery of the clock pulse is stopped in the clock signal MCLK to allow the respective memory cells to retain their states. This operation is performed at least once in the start of the operation of the LCD or when the number of the pixel elements for the image signal Vsig is changed.

Figure 10:
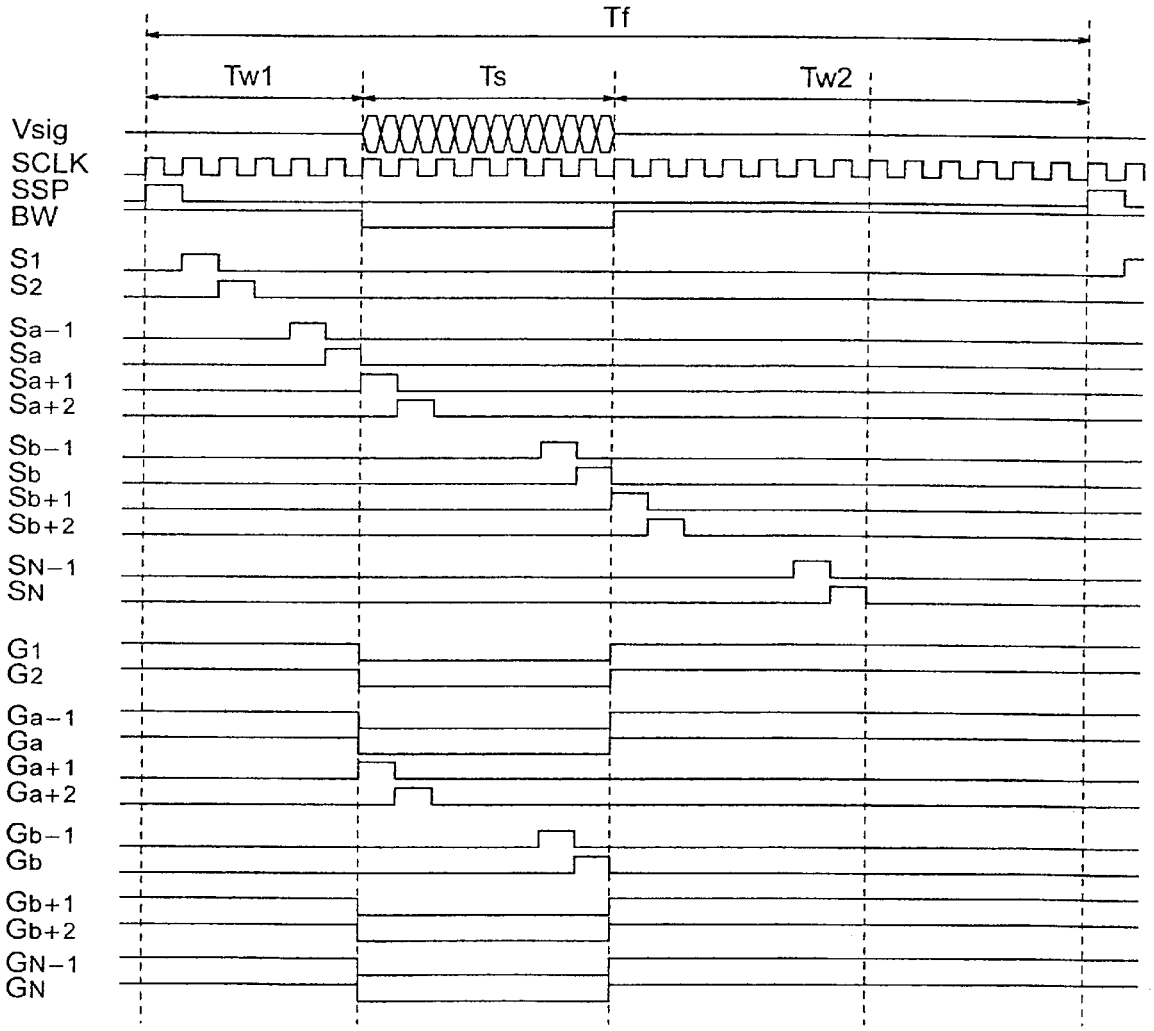
FIG. 10 is a timing chart of display operation for a picture image in the drive circuit of FIG. 8.

Referring to FIG. 10, in one frame period Tf for performing display of a picture image, the image signal Vsig is supplied during a sub-period Ts. The clock signal SCLK supplied to the scan circuit 42 has a frequency equal to the frequency of the horizontal synchronizing signal of the image signal Vsig. A single pulse having pulse width equal to the period of the clock signal SCLK is supplied in the control signal SSP in one frame period Tf. Thereby, the single pulse is sequentially transferred through the transfer elements of the respective stages in the scan circuit 42 in synchrony with the clock signal SCLK. As a result, $S_1$–$S_N$ sequentially rising and falling after one another, as shown in FIG. 10, are delivered through the outputs of the scan circuit 42.

By adjusting the rising edge of the control signal SSP in advance, it is determined that (a+1)-th output $S_{a+1}$, assumes a positive logical value at the start of the period Ts. This results in that the positive logical value is sequentially output through the outputs $S_{a+1}$–$S_b$ of the scan circuit 42 during the period Ts. As described above, since the data stored in the (a+1)-th to b-th memory cells in the memory circuit 41 assume a positive logical value, the outputs from the (a+1)-th to b-th logical units 43 coincide with the outputs from the scan circuit 42 by setting the control signal BW at a low level during the period Ts. As a result, pulses are sequentially output through the output terminals $G_{a+1}$–$G_b$.

The aforesaid pulses are supplied to the corresponding gate lines at the same time, whereby the image signal is stored in the pixel elements connected to the (a+1)-th to b-th gate lines. The control signal BW assumes a positive logical value except for the period Ts. Since the negative logical value is stored in the first to a-th and the (b+1)-th to N-th memory cells as described above, the outputs from the logical units 43 corresponding to these memory cells are positive in logical value irrespective of the outputs from the scan circuit 42. Accordingly, the first to a-th and the (b+1)-th to N-th gate lines are driven simultaneously. Therefore, in this period, by supplying the black signal to the LCD, clock signal can be written in the top and bottom areas all at once. At this stage, the top and bottom black areas are driven by a frame inversion drive scheme or a data line inversion drive scheme. By iterating these operations, a picture image can be displayed on the pixel elements in number fewer than the number of pixel elements provided in the LCD, whereas black color is displayed all at once in the top and bottom areas where the picture image is not displayed.

Figure 11:
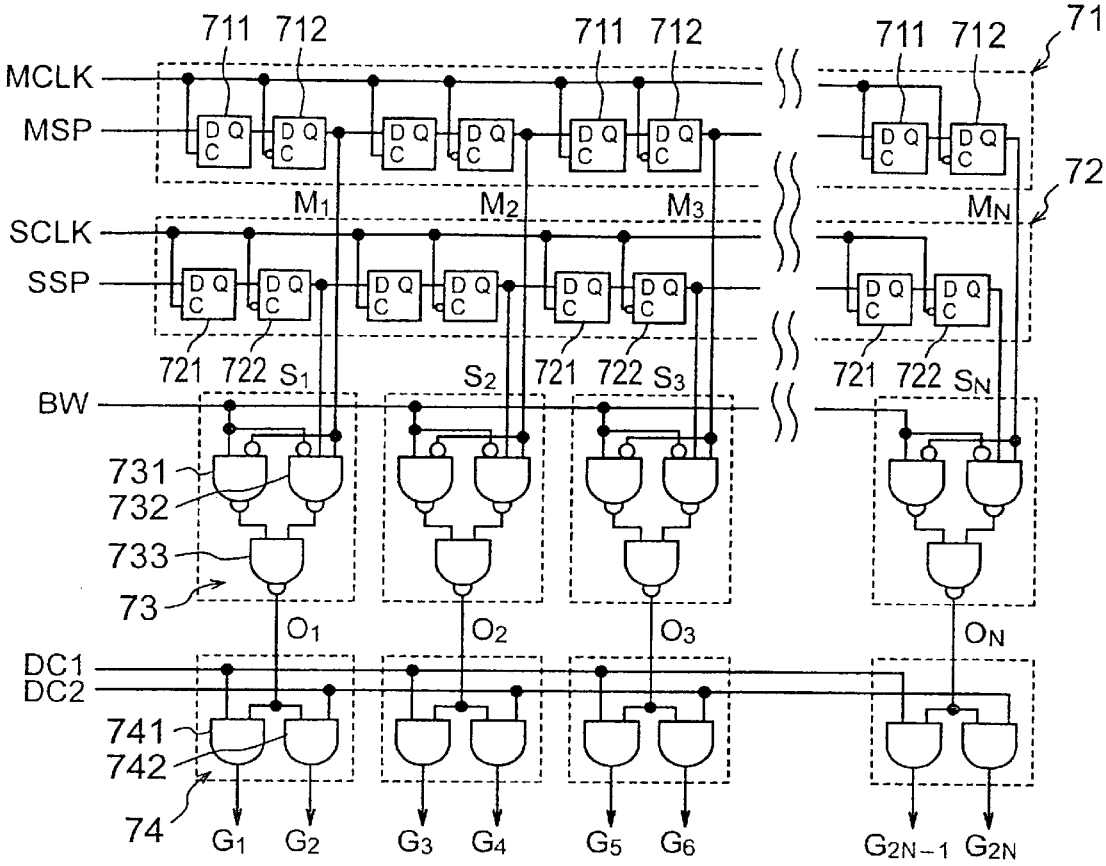
FIG. 11 is a circuit diagram of a concrete example of the gate driver circuit shown in FIG. 6.

Referring to FIG. 11 showing a concrete example of the gate driver circuit of FIG. 6, the gate driver circuit includes a memory circuit 71, a scan circuit 72, N logical units 73, and a gate line drive circuit including N decode units 74 each having a number (m=2) of outputs corresponding to the number of gate lines in each group of the gate lines.

The memory circuit 71 comprises N memory cells, each of which includes a pair of D-FFs 711 and 712. A clock signal MCLK and a control signal MSP are input to the memory circuit 71. The D-FF 711 receives data through the input terminal D thereof on the falling edge of the clock signal M y, and holds the data until the next falling edge of the clock signal MCLK The D-FF 712 receives data through the input terminal D thereof on the rising edge of the clock signal MCLK, and holds the data until the next rising edge of the clock signal MCLK Thereby, the memory circuit 71 latches data in the control signal MSP through the first memory cell (sequential number of 1) at the rising edge of the clock signal MCLK, and then sequentially transfers the data toward the succeeding memory cells at each of the level changes of the clock signal MCLK. The data stored in the respective memory cells are delivered through respective output terminals $M_1$–$M_N$.

The scan circuit 72 is implemented by a shift register including N-cascaded transfer elements, each of which includes a pair of D-FFs 721 and 722. A clock signal SCLK and a control signal SSP are input thereto. The scan circuit 72 receives data in the control signal SSP through the first stage transfer element at the rising edge of the clock signal SCLK, and then sequentially transfers the data toward the succeeding transfer elements at each of the level changes of the clock signal SCLK. The outputs of these transfer elements are delivered through respective output terminals $S_1$–$S_N$.

N logical units 73 are provided corresponding to N memory cells (711, 712) in the memory circuit 71 or N transfer elements (721, 722) in the scan circuit 72. Each of the logical units 73 includes three NAND gates 731, 732 and 733. The N logical units 73 receive the control signal BW, respective outputs among the outputs $M_1$–$M_N$ of the memory cells in the memory circuit 71 and the outputs $S_1$–$S_N$ of the transfer elements in the scan circuit 72. Each logical unit 73 performs a logical operation $M_n$*$S_n$*XWBW+X$M_n$*BW. If the control signal BW is negative, the outputs $O_1$–$O_N$ of the respective logical units 73 coincide with the outputs of the scan circuit 72 only when the data stored in the memory cells in the memory circuit 71 assumes a positive logical value. On the other hand, if the control signal BW assumes a positive logical value, the outputs of the gate driver circuit assume a positive logical value when the data stored in the respective memory cells in the memory circuit 71 assume a positive logical value irrespective of the outputs of the scan circuit 72.

N decode units 74 are provided corresponding to the outputs $O_1$–$O_N$of N logical units 73. Each of the decode units 74 includes m two-input AND gates. The outputs $O_1$–$O_N$ of the logical units 73 and m decode signals $DC_1$–$DC_m$ are input thereto. In such a configuration, the N decode units 74 output mxN outputs $G_1$–$G_{mxN}$ as the outputs of the gate driver circuit. Here, m is a positive even number, and is 2 in this example.

Now; operation of the gate driver circuit of FIG. 11 will be described with reference to FIGS. 12 and 13. The gate driver circuit operates for a write operation for the memory circuit 71 and a display operation for a picture image. In FIG. 11, the number of gate lines is 2N, and a picture image is displayed on the pixel elements connected to the (2a+1)-th to 2b-th gate lines among the 2N (m ×N) gate lines.

Figure 12:
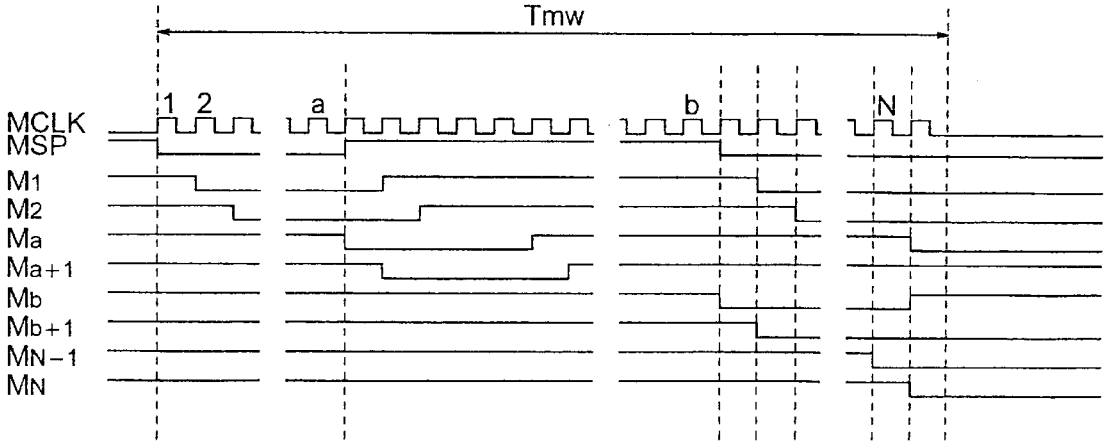
FIG. 12 is a timing chart of writing data in the memory circuit in the gate driver circuit of FIG. 11.

Referring to FIG. 12, N+1 clock pulses in the clock signal MCLK are supplied to the memory circuit 71, and the control signal MSP provided therein is in synchrony with the clock signal MCLK. The control signal MSP is negative during the first to a-th clock pulses, positive during the (a+1)-th to b-th clock pulse, and negative during the (b+1)-th to N-th clock pulses. Accordingly, after the N+1 clock pulses have been provided, the data of the memory circuit 71 is such that the first to a-th memory cells store a negative logical value, the (a+1)-th to b-th memory cells store a positive logical value, and the (b+1)-th to N-th memory cells store a negative logical value. At this instant, the delivery of the clock pulse is stopped in the clock signal MCLK to hold the respective memory cells in their states. This operation is performed at least once in the start of the operation of the LCD or when the number of pixel elements for the image signal Vsig is changed.

Figure 13:
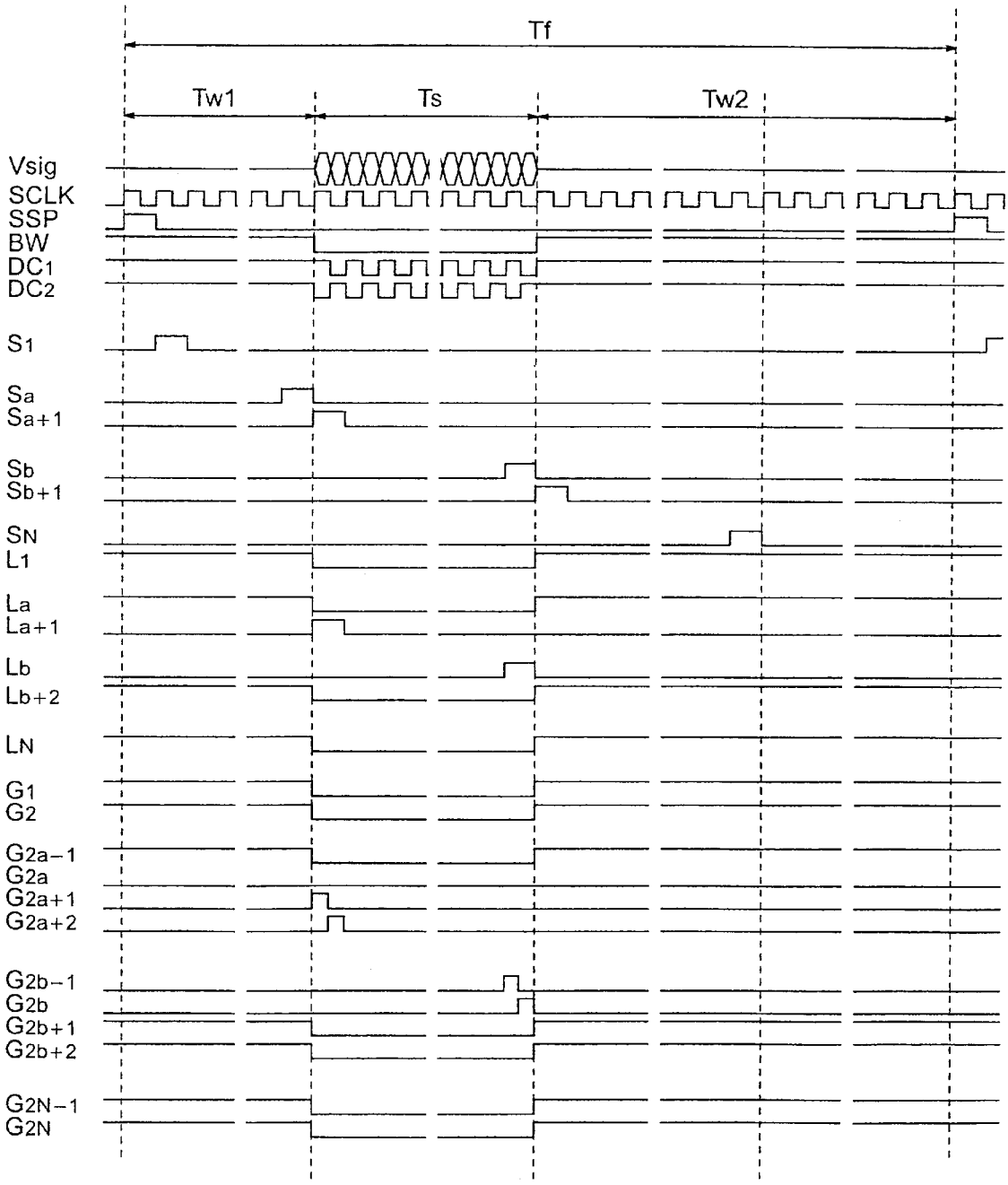
FIG. 13 is a timing chart of display operation for a picture image in the gate driver circuit of FIG. 12.

Referring to FIG. 13, in a single frame period Tf for displaying a picture image, the image signal Vsig is supplied during a sub-period Ts. The clock signal SCLK supplied to the scan circuit 72 has a frequency equal to ½ of the frequency of the horizontal synchronizing signal for the image signal Vsig. A single pulse having a pulse width equal to the period of the clock signal SCLK is supplied in the control signal SSP at the start of the frame period Tf. Thus, outputs of the memory circuit are sequentially transferred to the transfer elements in synchrony with the clock signal SCLK. As a result, $S_1$–$S_N$ are obtained as the outputs of the scan circuit 72.

By adjusting the timing of the pulse in the control signal SSP in advance, the (a+1)-th output $S_{a+1}$ has a positive logical value at the start of the sub-period Ts. Thus, the outputs delivered through the outputs $S_{a+1}S_b$ of the scan circuit 72 consecutively have a positive logical value during the sub-period Ts. In this case, since a positive logical value is stored in the (a+1)-th to b-th memory cells, the outputs $O_{a+1}$–$O_b$ of the (a+1)-th to b-th logical units 73 coincide with the outputs from the scan circuit 72 by setting the control signal BW at a negative logical value during the period Ts. In addition, decode signals $DC_1$ and $DC_2$ having a positive logical value, a pulse width narrower than the period of the horizontal synchronizing signal and a period equal to the period of the clock signal SCLK are provided as two phase pulses having therebetween a space equal to the pulse width. By this means, the (a+1)-th to b-th outputs among the outputs of the logical units 73 are respectively divided into two time-sharing pulses, and driving pulses are sequentially output through the output terminals $G_{2a+1}$–$G_{2b}$. The respective pulses drive the corresponding gate lines to write the image signal into the pixel elements connected to the (2a+1)-th to 2b-th gate lines.

The control signal BW is set at a positive logical value when the period Ts has passed. Since the negative logical value is written into the first to a-th and the (b+1)-th to N-th memory cells as described above, the outputs of the logical units 73 corresponding to these memory cells assume a positive logical value irrespective of the outputs of the scan circuit 72. The outputs are divided into two driving pulses in the corresponding decode units 74, and delivered through the output trials $G_1$–$G_{2a}$ and $G_{2b+1}$–$G_{2N}$. Since all the gate lines corresponding to these output terminals are simultaneously driven, a black signal can be supplied to the LCD in this period so as to write black data into the top and bottom areas simultaneously. In this case, the top and bottom black areas are driven by a frame inversion drive scheme or a data line inversion drive scheme. This example is applicable to a case where the number of the gate lines is m times as that of the example described with reference to FIGS. 8–10.

Figure 14:
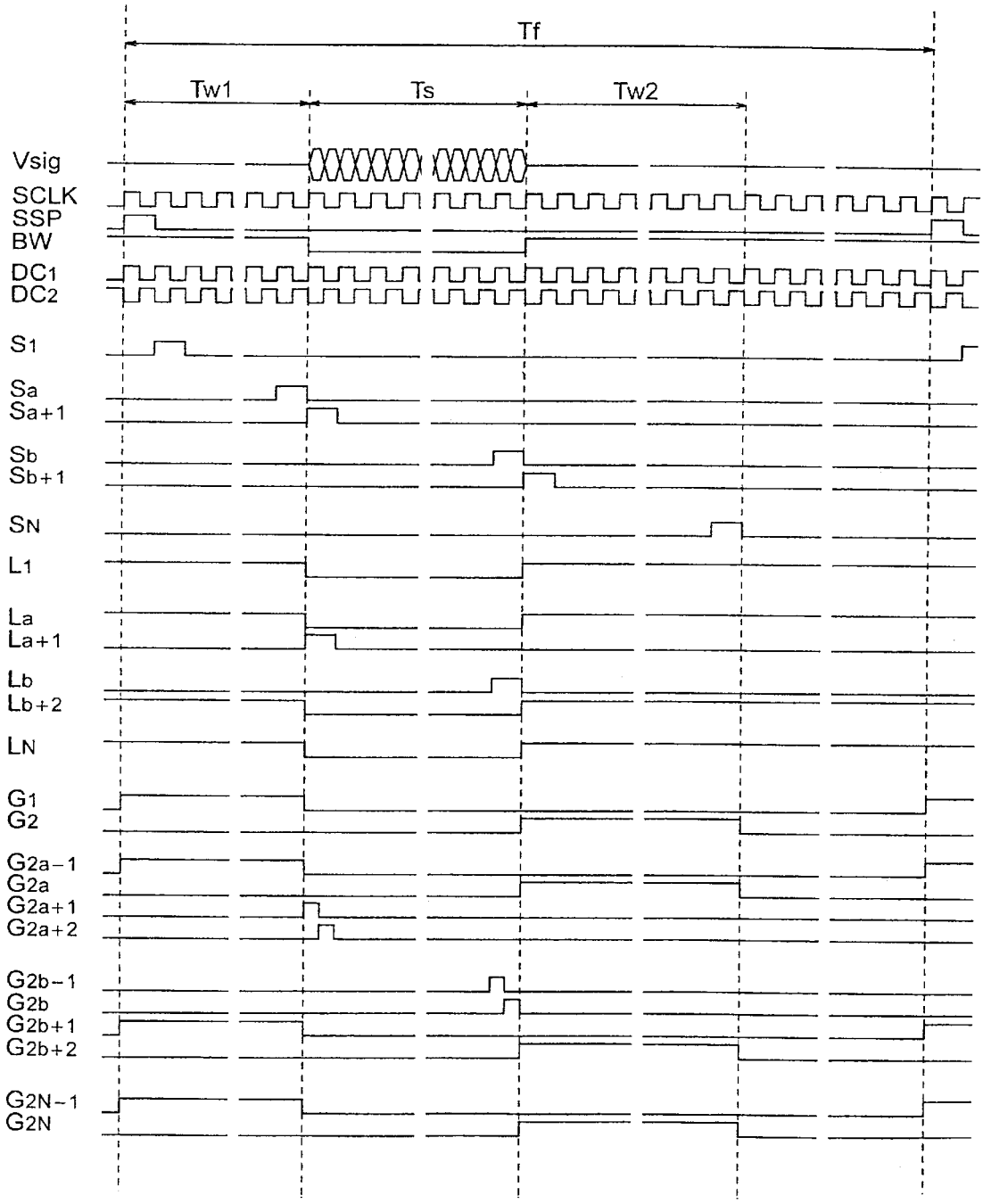
FIG. 14 is a timing chart of display operation for a picture image in another concrete example of the gate driver circuit shown in FIG. 6.

Referring to FIG. 14, there is shown a timing chart of another concrete example of the gate driver circuit of FIG. 11. In this example, the gate driver circuit operates for a write operation similarly to FIG. 12.

The operation of the gate driver circuit is also divided into a write operation mode for a memory circuit and a display operation mode for a picture image, similarly to FIG. 13. The number m of the outputs of the decode unit 74 is 2, and black data is displayed on the pixel elements connected to the (2a+1)-th to 2b-th gate lines among the 2N gate lines.

Specifically, a write operation to a memory circuit will be first described with reference to FIG. 12. N+1clock pulses are supplied in the clock signals MCLK to the memory circuit 71, and a control signal MSP in synchrony with the clock signal MCLK is supplied. The control signal MSP assumes a negative logical value during the fast to a-th clock pulses in the clock signal MCLK, a positive logical value during the (a+1)-th to b-th clock pulses, and a negative logical value during the (b+1)-th to N-th clock pulses. Accordingly, after N+1 clock pulses have passed in the clock signal MCLK, the data of the memory circuit 71 is such that the first to a-th memory cells have a negative logical value, the (a+1)-th to b-th memory cells have a positive logical value, and the (b+1)-th to N-th memory cells have a negative value. At this instant, the clock signal MCLK is stopped to hold the respective memory cells in their states. This operation is performed at least once at the start of the operation of the LCD or when the number of the pixel elements for a picture image is changed.

In FIG. 14, a single pulse having a width equal to the period of the clock signal SCLK is supplied in the control signal SSP in one frame period Tf. Thereby, the data are sequentially transferred toward the transfer elements in the scan circuit 72 in synchrony with the clock signal SCLK. As a result, the outputs $S_1$–$S_N$ of the scan circuit 72 are obtained.

By adjusting the ting of the pulse in the control signal SSP in advance, the (a+1)-th output $S_{a+1}$ has a positive logical value at the start of the period Ts. Accordingly, the outputs $S_{a+1}$–$S_b$ of the scan circuit 72 assume consecutively a positive logical value during the period Ts. In this case, since the (a+1)-th to b-th memory cells in the memory circuit 71 store a positive logical value, as described above, the outputs $O_{a+1}$–$O_b$ of the (a+1)-th to b-th logical units 73 coincide with the outputs from the scan circuit 72 by setting the control signal BW at a negative logical value during the period Ts. In addition, decode signals $DC_1$ and $DC_2$ having a positive logical value, a pulse width narrower than the period of the horizontal synchronizing signal and a period equal to the period of the clock signal SCLK are supplied as equally-spaced inverted phases. By this means, the outputs $O_{a+1}$–$O_b$ among the outputs of the logical units 73 are respectively divided by two, and are sequentially output through the output terminals $G_{2a+1}$–$G_b$ as the drive signals. The signals drive the corresponding gate lines to write the image signal into the pixel elements connected to the (2*a*+1)-th to 2*b*-th gate lines.

The period except for the sub-period A is divided into two or more periods. In a period Tw1 occurring before the period Ts, the control signal BW is set at a positive logical value, and the first to a-th and the (b+1)-th to N-th memory cells in the memory circuit 71 have a negative logical value. The outputs of the logical units 73 corresponding thereto have a positive logical value irrespective of the outputs of the scan circuit 72. At this stage, only the decode signal $DC_1$ is set at a positive logical value to divide the outputs of the logical units 73 into two pulses in the decode unit 74, whereby driving pulses are output through only the odd-numbered output terminals among the outputs $G_1$–$G_{2a}$ and $G_{2b+1}$–$G_{2N}$.

In the other period Tw2, the control signal BW is set at a positive logical value, and the first to a-th and the (b+1)-th to N-th memory cells have a negative logical value. The outputs of the logical units 73 corresponding thereto have a positive logical value irrespective of the outputs of the scan circuit 72. At this stage, if only the decode signal $DC_2$ is set at a positive logical value, driving pulses are output through only the even-numbered output terminals among the outputs $G_1$–$G_{2a}$ and $G_{2b+1}G_{2N}$ divided by the decode units 74.

The odd-numbered gate lines connected to the outputs $G_1$–$G_{2a}$ are driven simultaneously, and then the even-numbered gate lines connected to the outputs $G_{2b+1}$–$G_{2N}$ are driven simultaneously, In these periods, by supplying black signals, the black data are written into the top and bottom areas simultaneously. The top and bottom black areas can be driven by any of a frame inversion scheme, a data line inversion scheme, a gate line inversion scheme, and a dot inversion scheme. By iterating these operations, a simple driving method can be realized in the operation for displaying a picture image on the pixel elements in number fewer than the number of the pixel elements provided in the LCD, and the black data is displayed all at once on the top and bottom areas where the picture image is not displayed.

As described above, a gate driver circuit according to the present invention realizes the operations for a mutli-scan function, in which black data is simultaneously displayed on the top and bottom areas, obtaining the following advantages. First, the scan circuits can be operated with a frequency equal to or lower than that of the horizontal synchronizing signal for image signals. Second, complicated operations such as changing the clock frequency of the scan circuit are not required. This simplifies the configuration of the external drive circuit for controlling the gate driver circuit, allows a smaller circuit scale, and prevents complicated driving methods.

Since the above embodiments are described only for examples, the present invention is not limited to the above embodiments and various modifications or alterations can be easily made therefrom by those skilled in the art without departing from the scope of the present invention.

What is claimed is:

1. A drive circuit for driving an active matrix liquid crystal device (LCD) to operate for a picture writing period and a vertical blanking period, said drive circuit comprising:

a memory circuit, responsive to a first clock signal, including a plurality of memory cells each disposed for a corresponding group of gate lines of the LCD device, said memory circuit storing a first data in each of said memory cells corresponding to selected groups of said gate lines;

a plurality of cascaded transfer elements, each disposed for a corresponding one of said memory cells, for shifting clock pulses in a second clock signal along said transfer elements, said second clock signal being in synchrony with said first clock signal, and a gate line drive circuit including a plurality of logic units each disposed for a corresponding one of said memory cells, each of said logic units outputting a result signal based on a logic operation $M_n{*}S_n{*}XBW+XM_n{*}BW$ to a corresponding group of said gate lines, wherein Mn, XMn, Sn, BW, XBW and represent said first data from one of said memory cells corresponding to said each of said logic unit, the inverted first data, an output of one of said transfer elements corresponding to said each of said logic units, a control signal having a logic value depending on the picture writing period or the vertical blanking period, and an inverted control signal, respectively.

2. The drive circuit as defined in claim 1, wherein said gate line drive circuit further includes a plurality of decode units each disposed for a corresponding one of said memory cells, each of said decode units dividing said result signal into a number of pulses corresponding to a number of gate lines included in said group of the gate lines.

3. The drive circuit as defined in claim 1, wherein said group of the gate lines includes a single gate line.

4. The drive circuit as defined in claim 1, wherein said first clock signal has a frequency and a phase equal to a frequency and a phase of said second clock signal.

5. The drive circuit as defined in claim 1, wherein said first data are sequentially delivered in the picture writing period, and wherein said inverted first data are delivered simultaneously from the outputs of said logic units.

* * * * *